United States Patent [19]

Nonnenmacher

[11] Patent Number: 4,791,858

[45] Date of Patent: Dec. 20, 1988

[54] PISTON MACHINE

[75] Inventor: Gerhard Nonnenmacher, Korntal, Fed. Rep. of Germany

[73] Assignee: Robert Bosch GmbH, Stuttgart, Fed. Rep. of Germany

[21] Appl. No.: 123,894

[22] Filed: Nov. 23, 1987

[30] Foreign Application Priority Data

Dec. 9, 1986 [DE] Fed. Rep. of Germany ..... 3641955

[51] Int. Cl.[4] ..... F01B 1/06; F01B 13/06

[52] U.S. Cl. ..... 92/12.1; 91/486; 91/487; 91/507; 92/58

[58] Field of Search ..... 92/12.1, 54, 55, 58, 92/72, 148; 91/486, 487, 498, 491

[56] References Cited

U.S. PATENT DOCUMENTS 2,437,089 3/1948 Geiger et al. ..... 91/498
3,874,272 4/1975 Bosch ..... 91/498
3,893,376 7/1975 Wonnenmacher ..... 92/12.1

FOREIGN PATENT DOCUMENTS 1239955 7/1971 United Kingdom ..... 91/498

*Primary Examiner*—Edward K. Look
*Assistant Examiner*—Thomas Denion
*Attorney, Agent, or Firm*—Michael J. Striker

[57] ABSTRACT

A piston machine, particularly a radial piston machine which includes a pintle supporting a rotor which has a plurality of radially extending bores in which radial pistons are guided. These bores are in communication with control chambers formed in the pintle. One of the chambers is a high-pressure chamber and the other is a low-pressure chamber. Pre-control grooves and additional passages are provided at the control chambers to prevent, during the operation of the radial piston machine the occurrence of pressure shocks at the inner and outer dead centers.

7 Claims, 2 Drawing Sheets

PISTON MACHINE

BACKGROUND OF THE INVENTION

The present invention relates to a piston machine in general, and more particularly to a radial piston machine, such as a pump or motor.

Radial piston machines of the foregoing type have been known and have been disclosed, for example, in applicant's U.S. Pat. Nos. 3,985,065 and 3,893,376.

Mass flows of the pressure medium which pass through controlled profiles of such known so-called spool valve-controlled piston machines, particularly pumps, with a usual configuration of the pintle, occur in the dead centers within very short periods of time firstly against the direction of feeding (pressure-compensation-stream due to compressibility of the pressure medium) and then in the feeding direction. High pressure differences during the pressure-compensating steps cause in the control grooves the stream speeds which can be in the range of many hundred meters per second. The mass of the flowing pressure medium is, however, small despite the fact that the movement energy for quick steps to change directions cannot be neglected. This energy causes a delayed adjustment of the stream speeds to the changes in the directions of pressure medium flows. This leads to the disadvantage that upon the change from the high-pressure side to the low-pressure side in the inner dead center of the pump the pressure medium flows from the cylinder block to the low-pressure side of the pump only over a short time, also when the cylinder block pressure has already fallen below the level of low pressure. During the reverse from the low-pressure side to the high-pressure side in the outer dead center of the pump, the pressure medium flows for a short time from the high-pressure line into the cylinder block also when the cylinder block pressure has already risen above the level of the high pressure. This leads to distortion of the pressure medium course and impairing of the filling of the cylinder. Both these drawbacks increase noise emission and feeding stream pulsation of the pump.

SUMMARY OF THE INVENTION

It is an object of the present invention to provide an improved piston pump.

It is another object of this invention to provide a piston pump, in which noise emission and cylinder filling would be substantially improved.

Yet another object of the invention is to provide a piston machine in which the separation of the pressure-compensating process from the pressure medium-feeding process in the valve region would be substantial.

These and other objects of the invention are attained by a piston machine, particularly radial piston machine, comprising a control element for a rotor which has bores in which pistons move under the action of said control element, said control element in the region of each of said bores having a high-pressure control chamber and a low-pressure control chamber, and control passages which are in communication with said high-pressure and low-pressure control chambers, each chamber having, at a front side thereof, as viewed in the direction of rotation of said rotor, a pre-control means, an additional passage formed in said control element for each of said control chambers, said additional passage being laterally offset relative to a respective control chamber and extending from a place located between neighboring control chambers, said place defining an inner dead center or an outer dead center of said control element, said additional passage which extends from the outer dead center (AT) being in communication with said high-pressure control chamber and the additional passage which extends from the inner dead center (IT) being in communication with said low-pressure control chamber, each additional passage having a port which becomes periodically and for a short time connected to a respective one of said bores of said rotor before the communication of said bores with said pre-control means is established.

It is particularly advantageous that, with reference to the inner dead center, the pressure reduction in the cylinder chamber is obtained by the cross-section of a specific passage. By the accurate closing of this cross-section an undesired further stream of pressure medium which occurs in the known pumps due to the movement energy of the medium stream, is prevented. The pressure increase at the outer dead center in the cylinder chamber is obtained by the next following opening of the passage. By the accurate closing of this passage an undesired flow here is also prevented and outflows through the pre-control grooves start at correct times. Substantial pressure increase in the cylinder is prevented.

The low-pressure control chamber may be a machine housing.

The machine may further include a ring groove formed in said control element and extending about the same and being laterally offset relative to said control chambers, a pressure prevailing in said ring groove being substantially below a feeding pressure of the piston machine.

Each of the bores of the rotor may have a radially offset enlargement which cooperates with a port of each of said additional passages.

The rotor may have an additional bore radially offset relative to each of said bores, said additional bore cooperating with a port of the respective additional passage.

The pre-control means may be formed as grooves in the control element.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
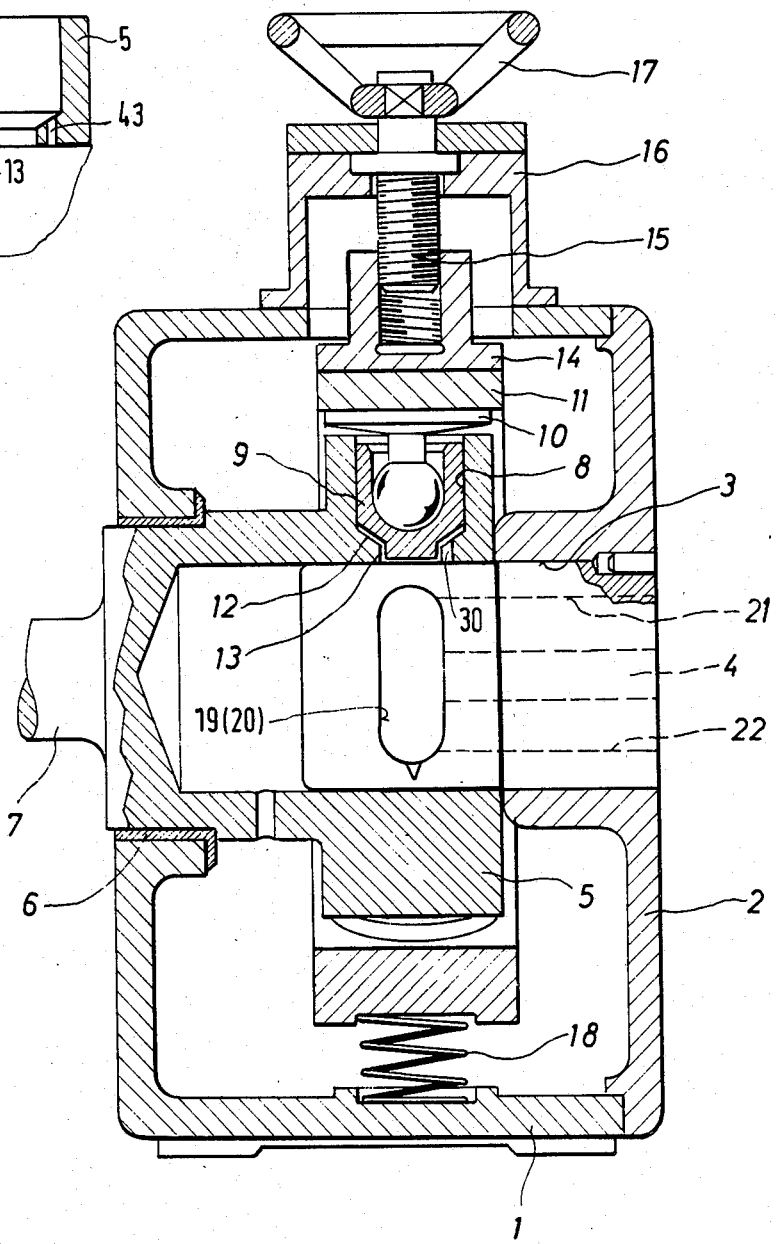
FIG. 1 is an axial sectional view of a radial piston machine according to the invention.

Referring now to the drawings in detail, FIG. 1 illustrates a radial piston pump which has a housing 1 closed by a separate cover 2. The cover is provided with a central bore 3 in which a slide block or pintle 4 is pressed, on which pintle rotates a rotor or cylinder block 5. The latter is supported in a bearing 6 inside the housing 1 and is driven via a shaft 7 by a non-shown but conventional prime mover. The pintle 4 is a control element in the pump of the foregoing type as known.

A plurality of radially extending cylindrical bores 8 are provided in the cylinder block 5. Pistons 9 which are tightly guided in bores 8 are provided within those bores in the conventional fashion. Pistons 9 each have an articulately mounted shoe or head 10 which is guided along the internal face of the slide ring 11. This slide ring 11 is, by means of a slide shoe 14 rigidly connected therewith and a threaded spindle 15 mating and cooperating with the internal thread of the slide shoe 14 and positioned in the extension 16 of housing 1, is displaceable transversely to the pintle 4, by a hand wheel 17 which turns the spindle 15. A helical spring 18 reacts against housing 1 and supports the slide ring 11 opposite the side shoe 14. The operation of the piston machine is described, for example in U.S. Pat. No. 3,893,376 the appropriate part of which is incorporated herein by reference.

As particularly shown in FIGS. 2–5 two control slots or elongated chambers 19 and 20 are formed in the periphery of pintle 4. These elongated chambers extend in the same radial plane and lie in the region of bores 13 of cylindrical bores 8. A bore 21, as shown in FIG. 1, which extends axially in the pintle 4, opens into the control chamber 19 while a bore 22 also axially extending in the pintle 4 opens into the control chamber 20. The control chamber 19 is assumed to constitute a high-pressure chamber and the control chamber 20 is assumed to constitute a low-pressure chamber.

A short triangular control groove 24 is provided at the front side of the control chamber 19, as viewed in direction of rotation of the rotor. A similar triangular groove 25 is provided at the control chamber 20. Both grooves are positioned on the axes of elongation of the control grooves 19, 20.

Approximately in the middle of the outer dead center AT but offset relative to the axis of control chamber 19, is positioned the port or mouth 26 of a passage 27 which is formed in the pintle 4 and opens in about the middle of the control chamber 19. The port or mouth 28 of a passage 29, in turn is positioned in the middle of the inner dead center IT and in the same radial plane as that of the port 26 of passage 27. Passage 29 extends in the pintle 4 from its mouth 28 to open in the middle of the control chamber 20. Each cylindrical bore 13 shown by dash-dotted line in FIGS. 2–5 has in the region of the passage mouths a recess 30. The distance between the mouth 26, 28 of each passages 27, 29 and the tip of the respective control groove 24, 25 or the diameter of the mouth of the cylindrical bore 13 is dimensioned in such a way that after the port of the high-pressure chamber 19 or the low-pressure chamber 20 is displaced the communication between the control groove 30 and the passage mouth or port 28 or 26 is established and after the recess or groove 30 passes the port or mouth 28 or 26 the communication with the next position control groove 25 or 24 is established. Due to the formation of the control groove 30 and the passage ports 26, 28 which are very small in cross-section these ports can open only over a very small angular region in the range of a few grades. The aforedescribed means have the following purpose: The pressure reduction in the cylindrical bore 13 is obtained at the inner dead center IT via control groove 30 and passage 29. By an accurate closing of the passage port and before approaching the communication between the cylindrical bore 13 and control groove 25 an undesired further flow which normally occurs due to the motion energy of the pressure medium stream in customary pumps is prevented. The inflow into the low-pressure control chamber 20 can start via the control groove 25 at the right time because the flow of the pressure medium should not be "twisted".

The pressure increase is obtained at the outer dead center AT in the cylindrical bore 13 via the passage 27. The pressure medium can drain from the high-pressure chamber 19 via the passage 27 into the cylindrical bore 13. By the accurate closing or sealing of the port 26 or passage 27 an undesired further flow of the pressure medium will be also prevented and the outflow of the pressure medium can start via the control groove 30 and cylindrical bore 13 towards the control groove 24 at the right point in time. The pressure increase in the cylindrical bore 13 will be thus avoided. It is possible in this manner to substantially reduce noise and a pumping flow pulsation with little expense in so-called slide-controlled piston pumps which are piston pumps with pintles.

Figure 2:
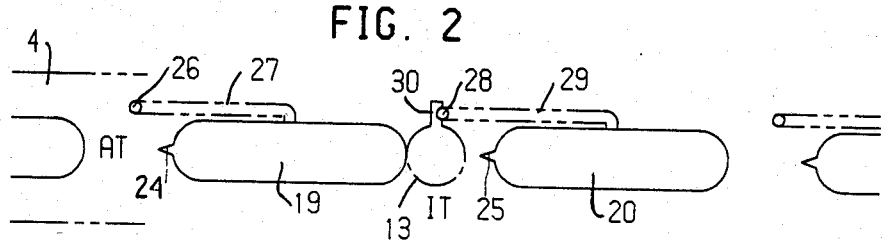
FIG. 2 is a fragmentary developed view of the pintle of the radial piston machine of the first embodiment.
Figure 3:
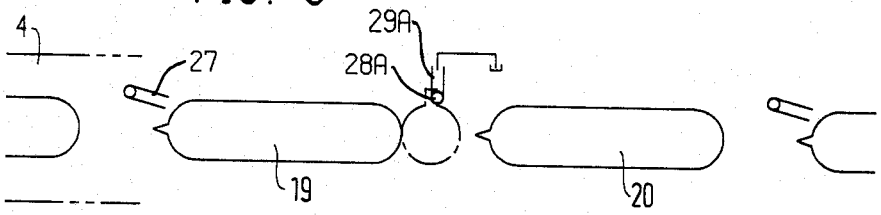
FIG. 3 is a fragmentary developed view of the pintle of the radial piston machine of the second embodiment.

The embodiment shown in FIG. 3 differs from the afore-described embodiment of FIG. 2 in that passage 29A which corresponds to passage 29 of the embodiment of FIG. 1 has no connection with the low-pressure chamber 20 but leads into the interior of the housing 1. Passage 27 has in principle the same contour that is it opens into the high-pressure chamber 19. The important fact is that passages 27, 29 must open into chambers 19, 20 as remote as possible from the control grooves 24, 25, respectively.

Figure 4:
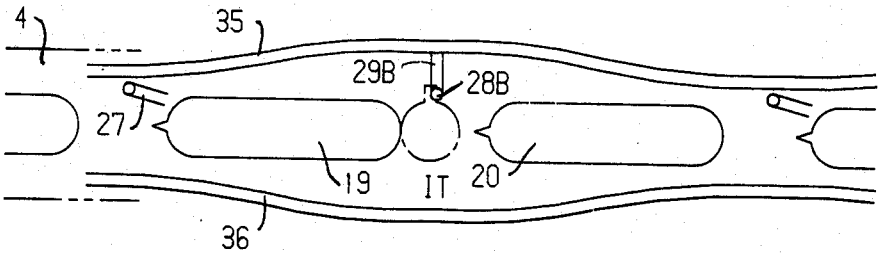
FIG. 4 is a fragmentary developed view of the pintle of the radial piston machine of the third embodiment.

The modification of the embodiment of FIG. 4 as compared to the above described embodiments resides in that grooves 35 and 36 are formed in the periphery of the pintle 4 at both sides of control chamber 19, 20. Grooves 35 and 36 serve to represent unloading of pressure fields which are not shown herein because they are of no importance for the invention. Passage 29B at the inner dead center opens into the ring groove 35. Pressure in the ring groove 35 amounts to approximately 25 to 35% of the operational pressure of the pump. Since by this time the pressure in the groove substantially exceeds the level of the low-pressure side an undesired drain of the cylindrical bore 13 due to the motion energy of the pressure medium stream will be prevented. A further advantage of the present invention is the improvement in the lubrication of the pintle 4 relative to the supporting-and-sealing strip, and also, as compared to unloading, a low-pressure-level-flexible adjustment of control times and changing operation conditions. Passage 27 corresponds to passages of the aforedescribed embodiments.

Figure 5:
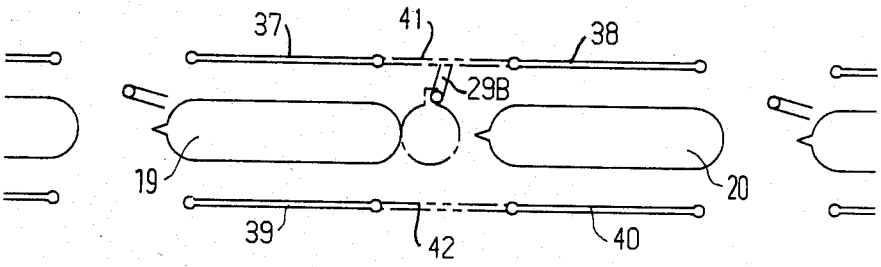
FIG. 5 is a fragmentary developed view of the pintle of the radial piston machine of yet another embodiment.

In the embodiment shown in FIG. 5 grooves 37, 38 and 39, 40 are elongated, straight, interrupted grooves provided in the periphery of pintle 4 at two sides of control chambers 19, 20. Grooves 35, 36 of the embodiment of FIG. 4 are in turn continuous. In each pair of grooves 37, 38 and 39, 40, two grooves are connected to each other by longitudinal bores 41, 42 formed in the pintle 4. Passage 29B drains the pressure medium into the bore 41 in which pressure again prevails, this pressure amounting to 25 to 35% of the operational pressure of the pump. Thereby a very accurate function similarly to the embodiment of FIG. 4 is obtained.

Figure 6:
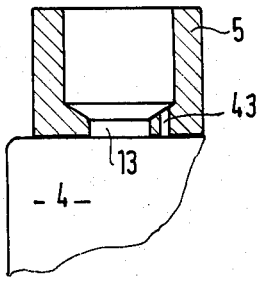
FIG. 6 is a partial sectional view of a modified unit.

In the embodiment shown in FIG. 6 an additional bore 43 of a small diameter, which is radially offset relative to the cylindrical bore 13, is provided in place of enlarging the bore 13 as in the above-described embodiments.

It is understandable that the aforedescribed arrangement can be applied also to axial piston pumps. Then, instead of the pintle 4, so-called flat control mirror slide would be used which has the same control chambers or slots which are formed in the flat plate.

It will be understood that each of the elements described above, or two or more together, may also find a useful application in other types of piston machines differing from the types described above.

While the invention has been illustrated and described as embodied in a piston machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. In a piston machine, particularly radial piston machine, comprising a control element for a rotor which has bores in which pistons move under the action of said control element, said control element in the region of each of said bores having a high-pressure control chamber (19) and a low-pressure control chamber (20), and control passages (21,22) which are in communication with said high-pressure and low-pressure control chambers, each chamber having, at a front side thereof, as viewed in the direction of rotation of said rotor, a pre-control means (24,25), the improvement comprising an additional passage (27,29) formed in said control element for each of said control chambers, said additional passage being laterally offset relative to a respective control chamber and extending from a place located between neighboring control chambers, said place defining an inner dead center or an outer dead center of said control element, said additional passage (27) which extends from the outer dead center (AT) being in communication with said high-pressure control chamber (19) and the additional passage (29) which extends from the inner dead center (IT) being in communication with said low-pressure control chamber (20), each additional passage having a port (26, 28) which becomes periodically and for a short time connected to a respective one of said bores (8) of said rotor (5) before the communication of said bores with said pre-control means (24, 25) is established.

2. The machine as defined in claim 1, wherein said low-pressure chamber is a low-pressure control slot.

3. The machine as defined in claim 1, wherein said low-pressure chamber is a machine housing.

4. The machine as defined in claim 1, further including a ring groove (35) formed in said control element and extending about the same and being laterally offset relative to said control chambers, a pressure prevailing in said ring groove being substantially below a feeding pressure of the piston machine.

5. The machine as defined in claim 1, wherein each of said bores (8) has a radially offset enlargement (30) which cooperates with a port (26, 28) of each of said additional passages.

6. The machine as defined in claim 1, wherein said rotor has an additional bore (43) radially offset relative to each of said bores (8), said additional bore cooperating with a port (26, 28) of the respective additional passage.

7. The machine as defined in claim 1, wherein said pre-control means (24, 25) are grooves.

* * * * *